US009413112B2

(12) United States Patent
Helster et al.

(10) Patent No.: US 9,413,112 B2
(45) Date of Patent: Aug. 9, 2016

(54) ELECTRICAL CONNECTOR HAVING CONTACT MODULES

(71) Applicant: Tyco Electronics Corporation, Berwyn, PA (US)

(72) Inventors: David Wayne Helster, Dauphin, PA (US); Linda Ellen Shields, Camp Hill, PA (US); Michael John Phillips, Camp Hill, PA (US); Bruce Allen Champion, Camp Hill, PA (US); Sandeep Patel, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 29 days.

(21) Appl. No.: 14/454,043

(22) Filed: Aug. 7, 2014

(65) Prior Publication Data

US 2016/0043508 A1 Feb. 11, 2016

(51) Int. Cl.

| | |
|---|---|
| ***H01R 13/648*** | (2006.01) |
| ***H01R 13/6467*** | (2011.01) |
| ***H01R 12/71*** | (2011.01) |
| ***H01R 12/72*** | (2011.01) |
| ***H01R 13/514*** | (2006.01) |
| ***H01R 13/6471*** | (2011.01) |
| ***H01R 13/6587*** | (2011.01) |
| *H01R 12/58* | (2011.01) |

(52) U.S. Cl.

CPC ..... *H01R 13/6467* (2013.01); *H01R 12/716* (2013.01); *H01R 12/724* (2013.01); *H01R 13/514* (2013.01); *H01R 13/6471* (2013.01); *H01R 13/6587* (2013.01); *H01R 12/585* (2013.01); *H01R 12/714* (2013.01); *H01R 12/727* (2013.01)

(58) Field of Classification Search

CPC .. H01R 23/688; H01R 13/518; H01R 13/659; H01R 13/6581; H01R 13/658; H01R 13/6586; H01R 13/6587; H01R 13/6585; H01R 23/668

USPC ..... 439/607.06, 607.04, 607.05, 607.07, 439/541.5, 607.11

See application file for complete search history.

(56) References Cited

U.S. PATENT DOCUMENTS

| | | | | |
|---|---|---|---|---|
| 7,175,446 | B2 * | 2/2007 | Bright | H01R 23/688 439/79 |
| 7,862,344 | B2 * | 1/2011 | Morgan | H01R 13/6467 439/108 |
| 8,298,015 | B2 * | 10/2012 | Cohen | H01R 13/65807 439/607.1 |
| 8,556,657 | B1 | 10/2013 | Nichols | |
| 2003/0119362 | A1 * | 6/2003 | Nelson | H01R 13/518 439/607.07 |

(Continued)

OTHER PUBLICATIONS

European Search Report dated Jan. 8, 2016 received in counterpart European Patent Application No. 15179873.3.

*Primary Examiner* — Abdullah Riyami
*Assistant Examiner* — Thang Nguyen

(57) ABSTRACT

An electrical connector includes a housing and a plurality of contact modules and ground plates held by the housing. Each contact module includes left and right signal wafers stacked next to each other along a stack axis. The signal wafers include electrical terminals held by a dielectric body. The electrical terminals have mounting contacts protruding from the dielectric body at a mounting face of the housing. The electrical terminals of at least one of the signal wafers in each contact module are jogged toward the other signal wafer such that the mounting contacts of each contact module align in a column. Each of the ground plates is disposed along an outer side of a corresponding contact module.

20 Claims, 6 Drawing Sheets

(56) References Cited

U.S. PATENT DOCUMENTS

2006/0189212 A1 8/2006 Avery et al.
2008/0176452 A1 7/2008 Fedder et al.
2011/0300757 A1* 12/2011 Regnier ..... H01R 29/00 439/626
2011/0318956 A1* 12/2011 Long ..... G02B 6/0001 439/490
2013/0017726 A1 1/2013 Davis et al.
2013/0340251 A1 12/2013 Regnier et al.
2015/0236451 A1* 8/2015 Cartier, Jr. ..... H01R 13/6598 439/607.05

* cited by examiner

ELECTRICAL CONNECTOR HAVING CONTACT MODULES

BACKGROUND OF THE INVENTION

The subject matter herein relates generally to electrical connectors that have contact modules.

Some electrical systems utilize an electrical connector, such as a receptacle or header connector, to interconnect a circuit board and at least one pluggable module. The electrical connector is mounted to the circuit board. For example, the electrical connector includes electrical terminals with tails that terminate to conductive vias on the circuit board. The circuit board has signal traces routed from the conductive vias. An opposite end of the electrical terminals may extend into a mating interface of the electrical connector for electrical connection to a circuit card or electrical contacts of a corresponding pluggable module mated to the electrical connector. A conductive signal pathway is formed that includes the circuit card or an electrical contact of the pluggable module, the electrical terminal of the electrical connector that engages the circuit card or electrical contact, and the signal trace routed from the conductive via that engages the electrical terminal.

Due to size constraints of electrical connectors, increasing density of electrical terminals in electrical connectors, and the desire for smaller connector footprints, the signal traces on the circuit board are routed away from the footprint of the electrical connector in close proximity to one another and often in multiple layers of the circuit board. As the density of electrical terminals in the electrical connector increases, there is less space between corresponding vias of the circuit board to route the signal traces away from the connector footprint. Signal trace routing is further complicated when the electrical terminal tails at the connector footprint are arranged in various groupings or arrays that do not provide designated routes for signal traces between the corresponding vias that engage the electrical terminal tails. One known way to accommodate additional electrical terminal tails is to increase the number of layers of the circuit board used to route the signal traces away from the connector footprint. However, thick circuit boards are undesirable and more expensive to manufacture than thinner boards having fewer layers.

A need remains for an electrical connector that facilitates routing of signal traces in a circuit board on which the connector is mounted.

BRIEF DESCRIPTION OF THE INVENTION

In one embodiment, an electrical connector is provided that includes a housing having a mounting face and a mating face, a plurality of contact modules held by the housing, and a plurality of ground plates also held by the housing. Each contact module includes a left signal wafer and a right signal wafer stacked next to each other along a stack axis. Each of the signal wafers extends parallel to a contact module plane. The signal wafers include electrical terminals held by a dielectric body. The electrical terminals have mounting contacts protruding from the dielectric body at the mounting face of the housing. The electrical terminals of at least one of the signal wafers in each contact module are jogged toward the other signal wafer in the contact module. The mounting contacts of each contact module align in a column that extends parallel to the contact module plane. Each of the ground plates extends parallel to the contact module plane and is disposed along an outer side of a corresponding contact module.

In another embodiment, an electrical connector is provided that includes a housing, a plurality of contact modules, a plurality of ground plates, and a plurality of ground cross connects. The housing has a mounting face and a mating face. The contact modules and the ground plates are held by the housing. The ground cross connects are at the mounting face of the housing. Each contact module includes a left signal wafer and a right signal wafer stacked next to each other along a stack axis. Each of the signal wafers extends parallel to a contact module plane. The signal wafers include electrical terminals held by a dielectric body. The electrical terminals have mounting contacts protruding from the dielectric body at the mounting face of the housing. Each of the ground plates extends parallel to the contact module plane and is disposed along an outer side of a corresponding contact module. The mounting contacts and the ground contacts are arranged in an array at the mounting face of the housing. The array includes plural columns extending parallel to the contact module plane. Each column has a ground contact disposed between mounting contacts to provide shielding therebetween. Adjacent columns in the array are separated by a column void. Each ground cross connect extends across at least one contact module and electrically and mechanically engages corresponding ground plates at opposite sides of the at least one contact module. The ground cross connects each have at least one ground contact.

DETAILED DESCRIPTION OF THE INVENTION

Embodiments set forth herein include electrical connectors that mount to circuit boards. The electrical connectors provide spaces for signal trace routes along the circuit boards away from the footprints of the electrical connectors. The electrical connectors described herein reduce the need to add additional layers to and/or increase the area of the circuit boards upon which the electrical connectors are mounted.

Figure 1:
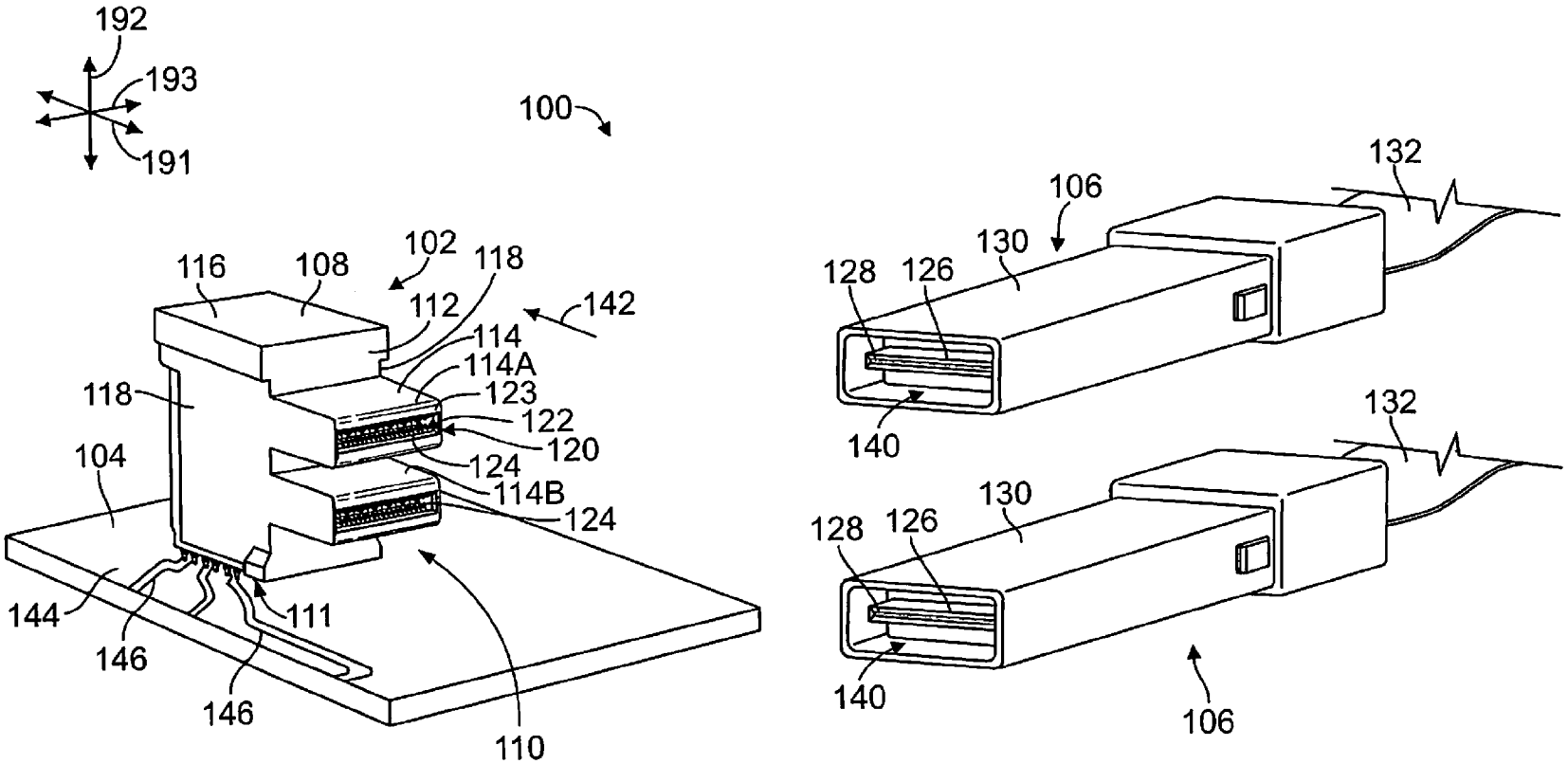
FIG. 1 is a perspective view of an electrical system in accordance with an exemplary embodiment.

FIG. 1 is a perspective view of an electrical system 100 in accordance with an exemplary embodiment. The electrical system 100 includes an electrical connector 102 that is mounted on a host circuit board 104. The electrical system 100 further includes pluggable modules 106 that are configured to mate with the electrical connector 102 to electrically connect the pluggable modules 106 to the electrical connector 102. Signals are transmitted between the pluggable modules 106 and the circuit board 104 through the electrical connector 102. Two pluggable modules 106 are shown in FIG. 1, although the electrical connector 102 may be configured to engage more or less than two pluggable modules in alternative embodiments. The electrical system 100 is oriented with respect to a longitudinal axis 191, an elevation axis 192, and a lateral axis 193. The axes 191-193 are mutually perpendicular. Although the elevation axis 192 appears to extend in a vertical direction parallel to gravity in FIG. 1, it is understood that the axes 191-193 are not required to have any particular orientation with respect to gravity.

The electrical connector 102 has a connector housing 108. A plurality of contact modules 204 (shown in FIG. 2) and ground plates 206 (FIG. 2) are held by the housing 108. The contact modules 204 and/or the ground plates 206 are held at least partially within the housing 108. The housing 108 has a mating face 110 and a mounting face 111. The mating face 110 is configured to engage the pluggable modules 106. The mounting face 111 is configured to engage the circuit board 104. The mating face 110 includes a front wall 112 and at least one mating interface 114 extending forward from the front wall 112 along the longitudinal axis 191. In the illustrated embodiment, the mating face 110 includes first and second mating interfaces 114A, 114B, respectively. The first mating interface 114A is stacked over the second mating interface 114B along the elevation axis 192 such that the second mating interface 114B is positioned between the first mating interface 114A and the circuit board 104. The electrical connector 102 may include other than two mating interfaces 114 and/or different relative arrangements of mating interfaces 114 in other embodiments.

Figure 2:
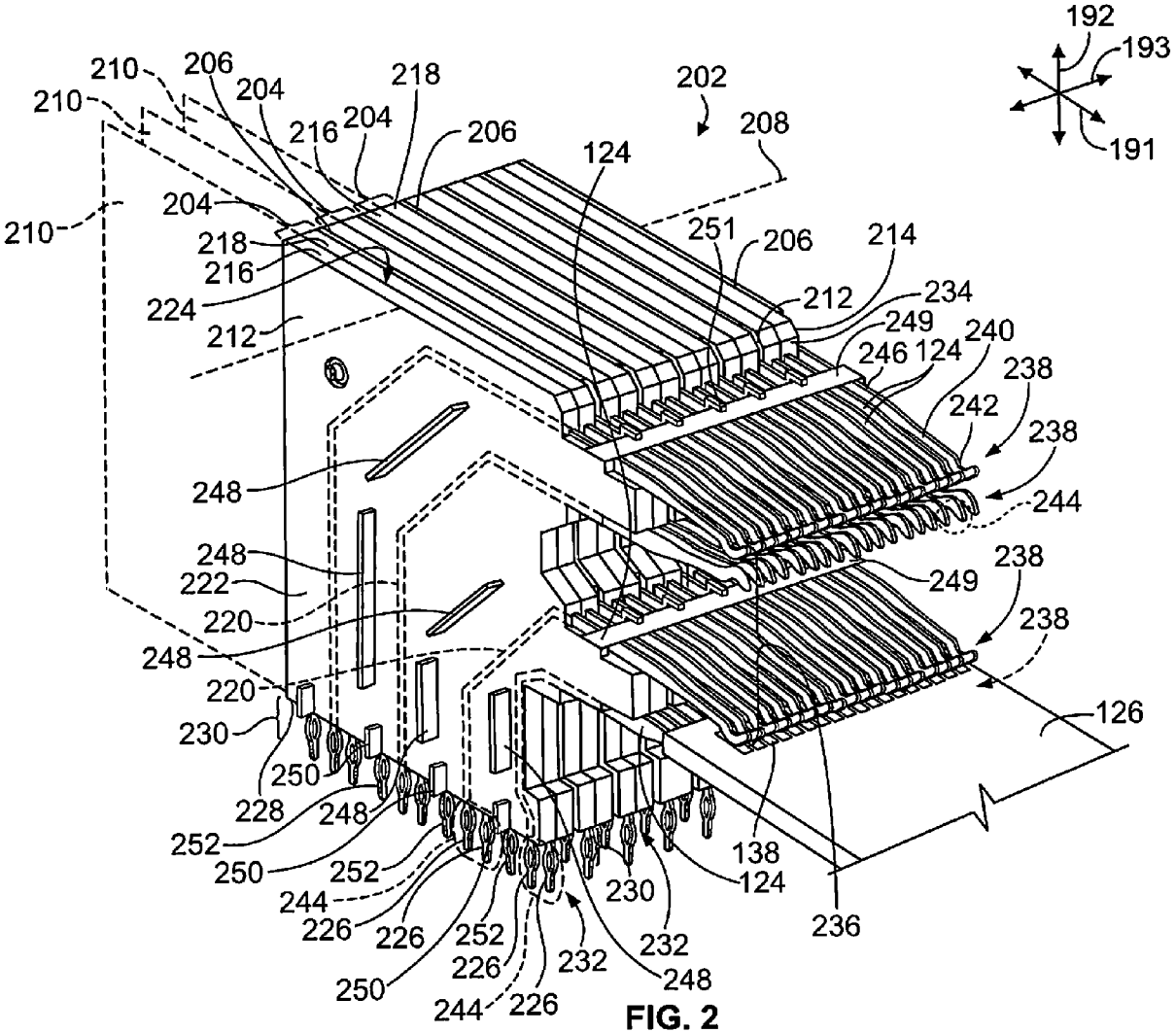
FIG. 2 is a perspective view of a module stack of an electrical connector according to an exemplary embodiment.

The front wall 112 of the housing 108 is joined to other walls to define a module cavity (not shown) that receives the contact modules 204 (shown in FIG. 2) and ground plates 206 (FIG. 2). For example, the housing 108 has a top wall 116, opposing side walls 118, and a back wall (not shown) that is opposite the front wall 112. As used herein, relative or spatial terms such as "top," "bottom," "upper," "lower," "left," and "right" are only used to distinguish the referenced elements and do not necessarily require particular positions or orientations in the electrical system 100 or in the surrounding environment of the electrical system 100. The mounting face 111 of the housing 108 may be at least partially open to allow the contact modules 204 and ground plates 206 protrude from the module cavity to mount and electrically connect to the circuit board 104.

The circuit board 104 may be a daughter card or a mother board in the electrical system 100. The circuit board 104 may include multiple insulating layers and conductive layers stacked on each other. The circuit board 104 includes conductive elements, such as pads and/or vias, arranged in an array at a top surface 144 of the circuit board 104. The conductive elements may be positioned to align with mounting contacts of the electrical connector 102 at the mounting face 111, such that the conductive elements engage the contacts when the electrical connector 102 is mounted to the circuit board 104. Conductive traces 146 extend from each of the conductive elements away from the footprint of the electrical connector 102. The footprint is defined by the layout of contacts at the mounting face 111 of the housing 108. The conductive traces 146 may be disposed on different conductive layers of the circuit board 104. In an exemplary embodiment, the footprint of the electrical connector 102 defines column voids that provide corresponding spaces on the circuit board 104 for routing traces to/from the contacts at the mounting face 111. The circuit board 104 may thus be thinner or use fewer layers for routing the traces 146 from the electrical connector 102. Any additional layers of the circuit board 104 not used for routing traces 146 from the electrical connector 102 may be used to route other traces for other electrical components mounted to the circuit board 104.

The pluggable modules 106 optionally may be input/output (I/O) transceivers configured to transmit data signals in the form of electrical signals and/or optical signals. Each pluggable module 106 has a shell 130 and is connected to a cable 132. The shell 130 houses and at least partially surrounds an internal circuit board 126. In an embodiment, the cable 132 may be directly attached to the internal circuit board 126 within the shell 130. In an alternative embodiment, the pluggable module 106 may have a receptacle (not shown) that receives a plug connector (not shown) at an end of the cable 132 to allow for selective mating between different modules and cables. An edge 128 of the internal circuit board 126 is disposed within a socket 140 of the shell 130. The socket 140 is configured to receive therein a corresponding mating interface 114 of the electrical connector 102 when the pluggable module 106 mates to the electrical connector 102. To mate with the electrical connector 102, the pluggable module 106 is advanced along the longitudinal axis 191 in a mating direction 142 towards the mating interface 114.

The at least one mating interface 114 of the electrical connector 102 includes a port or opening 120 at a front end 123. The port 120 is open to a mating cavity 122 within the mating interface 114. A plurality of mating contacts 124 of the contact modules 204 (shown in FIG. 2) and the ground plates 206 (FIG. 2) are disposed within the mating cavity 122. The mating contacts 124 may be contact beams that are configured to electrically connect to the internal circuit board 126 of a corresponding mating pluggable module 106. The port 120 is sized and shaped to receive the internal circuit board 126 therethrough. For example, the edge 128 of the internal circuit board 126 is loaded through the port 120 of the mating interface 114 when the pluggable module 106 mates with the mating interface 114. The edge 128 of the internal circuit board 126 is received within the mating cavity 122, where conductors on the circuit board 126 electrically connect to the mating contacts 124 of the electrical connector 102.

FIG. 2 is a perspective view of a module stack 202 of the electrical connector 102 (shown in FIG. 1) in accordance with an embodiment. The module stack 202 includes the components of the electrical connector 102 within the connector housing 108 (shown in FIG. 1). The module stack 202 includes a plurality of contact modules 204 and ground plates 206 stacked side-by-side along a stack axis 208. For example, in the illustrated embodiment the contact modules 204 and ground plates 206 are arranged in an alternating sequence such that adjacent contact modules 204 are separated by a ground plate 206. Likewise, adjacent ground plates 206 are separated by a contact module 204. The contact modules 204 have a left outer side 212 and a right outer side 214. Each ground plate 206 is disposed along the left outer side 212 or the right outer side 214 of a corresponding contact module 204. The ground plates 206 may abut the outer sides 212, 214 of the contact modules 204.

Each contact module 204 extends along a contact module plane 210. The contact module planes 210 of the contact modules 204 may be parallel to each other. The contact module planes 210 may be perpendicular to the stack axis 208. Each contact module 204 includes a left signal wafer 216 and a right signal wafer 218 stacked next to each other along the stack axis 208. The signal wafers 216, 218 each extend parallel to the contact module plane 210. The left and right signal wafers 216, 218 abut each other at an interface or seam 224. In an embodiment, at least part of the interface 224 defines the contact module plane 210.

The left and right signal wafers 216, 218 each include electrical terminals 220 held by a dielectric body 222. For example, the electrical terminals 220 may be over-molded with a dielectric material to form the signal wafers 216, 218. In FIG. 2, the electrical terminals 220 of the left signal wafer 216 are shown in phantom. Each signal wafer 216, 218 includes four electrical terminals 220. In alternative embodiments, the signal wafers 216, 218 may include more or less than four electrical terminals 220. The electrical terminals 220 have mounting contacts 226 protruding from the dielectric body 222 at a mounting edge 228 of the dielectric body 222. The mounting contacts 226 are configured to be electrically terminated to the host circuit board 104 (shown in FIG. 1). For example, the mounting contacts 226 may extend downward (for example, towards the circuit board 104) from the mounting edge 228. In an exemplary embodiment, the mounting contacts 226 are pin contacts, such as compliant eye-of-the-needle-type contacts. Pin contacts facilitate press-fit termination of the electrical connector 102 (shown in FIG. 1) to the host circuit board 104 via thru-hole mounting. The mounting contacts 226 may be terminated to the circuit board 104 by other methods in alternative embodiments, such as via soldering to contact pads on the circuit board 104.

In an exemplary embodiment, all of the mounting contacts 226 of the left and right signal wafers 216, 218 of each contact module 204 align in a column 230. The column 230 extends parallel to the contact module plane 210, and optionally is co-planar with the contact module plane 210. The column 230 of one contact module 204 is separated from an adjacent column 230 of an adjacent contact module 204 by a column void 232. The column void 232 extends the length of the module stack 202 along the longitudinal axis 191. The column void 232 is devoid of electrical contacts. When the electrical connector 102 (shown in FIG. 2) is mounted to the circuit board 104 (FIG. 1), the column voids 232 between columns 230 of mounting contacts 226 provide spaces on the circuit board 104 for routing signal traces 146 (FIG. 1) away from the footprint of the electrical connector 102, as described further herein.

The electrical terminals 220 of the left and right signal wafers 216, 218 further include the mating contacts 124. The mating contacts 124 protrude from the dielectric body 222 at a mating edge 234 of the dielectric body 222. For example, the mating contacts 124 extend forward from the corresponding dielectric bodies 222 along the longitudinal axis 191. The mating contacts 124 are configured to electrically and mechanically engage contact pads 138 of the internal circuit board 126 of a corresponding pluggable module 106. The mating contacts 124 of each wafer 216, 218 may be oriented in a column 236 that extends along the elevation axis 192. Each wafer 216, 218 in FIG. 2 includes four mating contacts 124, with one mating contact 124 extending from each of the four electrical terminals 220. The mating contacts 124 of the contact modules 204 align in rows 238 parallel to the stack axis 208. For example, the mating contacts 124 of each signal wafer 216, 218 may align in multiple different rows 238. In an embodiment, each mating interface 114 (shown in FIG. 1) of the housing 108 (FIG. 1) houses two rows 238 of mating contacts 124. One row 238 defines an upper row that is configured to engage a top surface of the corresponding internal circuit board 126 of the mating pluggable module 106 (FIG. 1), and the other row 238 defines a lower row that engages a bottom surface of the internal circuit board 126.

In an embodiment, the mating contacts 124 include an elongated arm 240 and a mating tip 242. The arm 240 extends from the mating edge 234 of the dielectric body 222 to the mating tip 242. The mating tip 242 is configured to mechanically and electrically engage a corresponding contact pad 138 on the internal circuit board 126 of one of the pluggable modules 106 (shown in FIG. 1). The arm 240 may be configured to deflect as the mating tip 242 engages the contact pad 138 to provide a biasing force that retains the mechanical connection between the mating tip 242 and the contact pad 138. In an embodiment, adjacent mating contacts 124 (in the same row) of the left and right signal wafers 216, 218 in each contact module 204 are arranged as differential pairs 244 that transmit differential signals. For example, the mating contact 124 of the left signal wafer 216 may be a positive contact, and the mating contact 124 of the right signal wafer 218 in the differential pair 244 may be a negative contact, or vice-versa. In an embodiment, each differential pair 244 is further arranged as adjacent mounting contacts 226 in the same column 230. As such, each differential pair 244 is formed of one electrical terminal 220 of the left signal wafer 216 and one electrical terminal 220 of the right signal wafer 218 in one contact module 204. At the mating edges 234, the mating contacts 124 of one differential pair 244 are aligned side-by-side along the stack axis 208, but at the mounting edges 228, the mounting contacts 226 of the same differential pair 244 are aligned front-to-back parallel to the contact module plane 210.

The ground plates 206 extend parallel to the contact module planes 210. The ground plates 206 are formed of a thin conductive material that is not over-molded or otherwise encapsulated with a dielectric material. The ground plates 206 each include ground mating contacts 246 that align laterally with the mating contacts 124 of the contact modules 204 in the rows 238. For example, each ground plate 206 may include four ground mating contacts 246 that each align in a different one of the rows 238. For the ground plates 206 disposed between two contact modules 204 (for example, located away from the edges of the module stack 202), each ground mating contact 246 is disposed between two mating contacts 124. The ground mating contacts 246 provide shielding between the mating contacts 124 of the adjacent contact modules 204, to reduce crosstalk that degrades electrical performance.

The module stack 202 may include ground tie bars 248 that extend across a width of the module stack 202 along the stack axis 208 and provide shielding and/or a reference ground plane between the electrical terminals 220 of each signal wafer 216, 218. The ground tie bars 248 extend through slots (not shown) in the contact modules 204 and the ground plates 206. The slots in the ground plates 206 may be sized and shaped such that the ground plates 206 mechanically and electrically connect to the ground tie bars 248 to electrically common the plural ground plates 206 in the module stack 202. The module stack 202 optionally may include mating ground tie bars 249 that extend across the width of the module stack 202 and engage the ground mating contacts 246. The mating ground tie bars 249 electrically common the ground mating contacts 246 of a corresponding row 238 external of the dielectric bodies 222. The ground mating contacts 246 optionally may have retention fingers 251 that engage the mating ground tie bars 249 and secure the ground tie bars 249 in place.

In an exemplary embodiment, the module stack 202 includes ground cross connects 250. The ground cross connects 250 are disposed at the mounting edges 228 of the signal wafers 216, 218 at or near the mounting face 111 (shown in FIG. 1) of the housing 108 (FIG. 1). Each ground cross connect 250 extends across at least one contact module 204 transverse to the contact module plane 210. The ground cross connect 250 is configured to mechanically and electrically engage the corresponding ground plates 206 at opposite sides of the at least one contact module 204. Like the ground tie bars 248, the ground cross connects 250 provide shielding between electrical terminals 220 and also electrically common the corresponding ground plates 206. Four ground cross connects 250 are shown in FIG. 2, although the module stack 202 may include additional ground cross connects 250 that are not visible in the illustrated embodiment.

In an exemplary embodiment, the ground cross connects 250 include at least one ground mounting contact 252, referred to herein as ground contact 252, that is configured to mount to the host circuit board 104 (shown in FIG. 1). Each ground contact 252 aligns with the mounting contacts 226 of the electrical terminals 220 in one of the columns 230. For example, as described further below, at least some of the ground contacts 252 are each disposed between two mounting contacts 226 in the same column 230, such that the ground contact 252 provides shielding between the mounting contacts 226. One ground contact 252 may extend between mounting contacts 226 of two different differential pairs 244. In an embodiment, the ground plates 206 do not include ground contacts that mount to the circuit board 104, but the ground cross connects 250, which engage and extend between the ground plates 206, do include ground contacts 252. By aligning the ground contacts 252 with the mounting contacts 226 in the columns 230, the column voids 232 defined between adjacent columns 230 may be wider along the stack axis 208 than if the ground contacts 252 did not align with the mounting contacts 226. Increased width of the column voids 232 increases the space along the circuit board 104 to accommodate routing of signal traces 146 (shown in FIG. 1).

Figure 3:
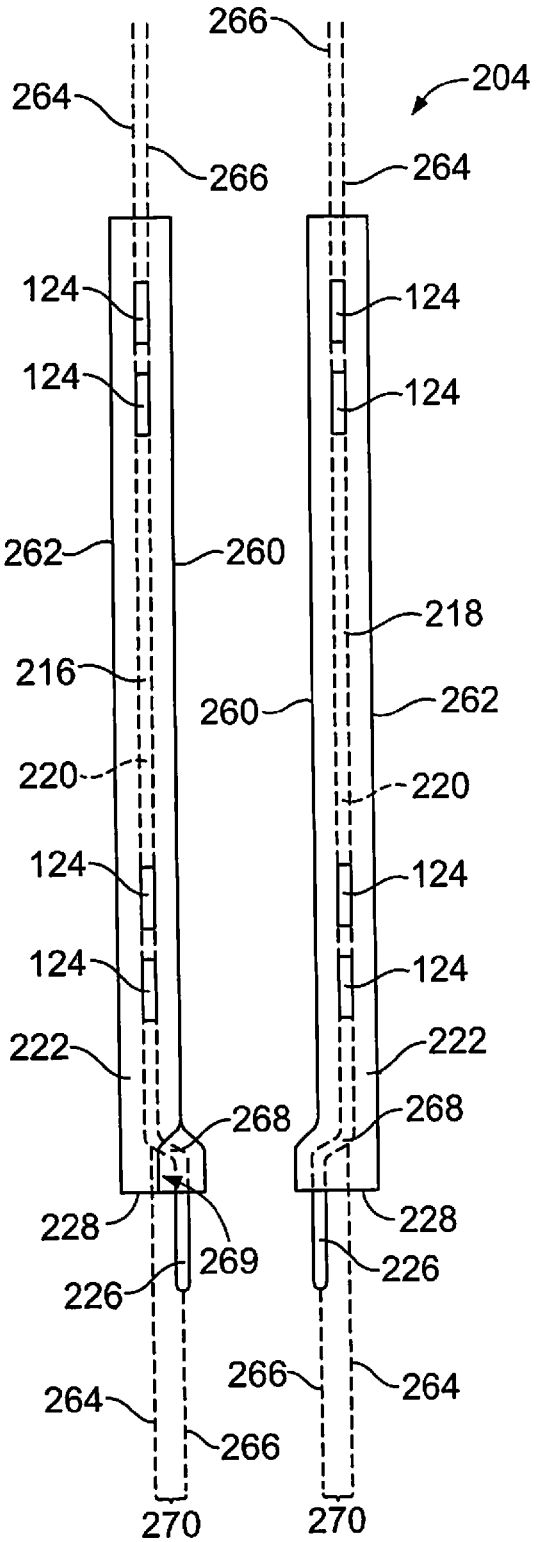
FIG. 3 is a front exploded view of a contact module of the electrical connector according to an embodiment.
Figure 4:
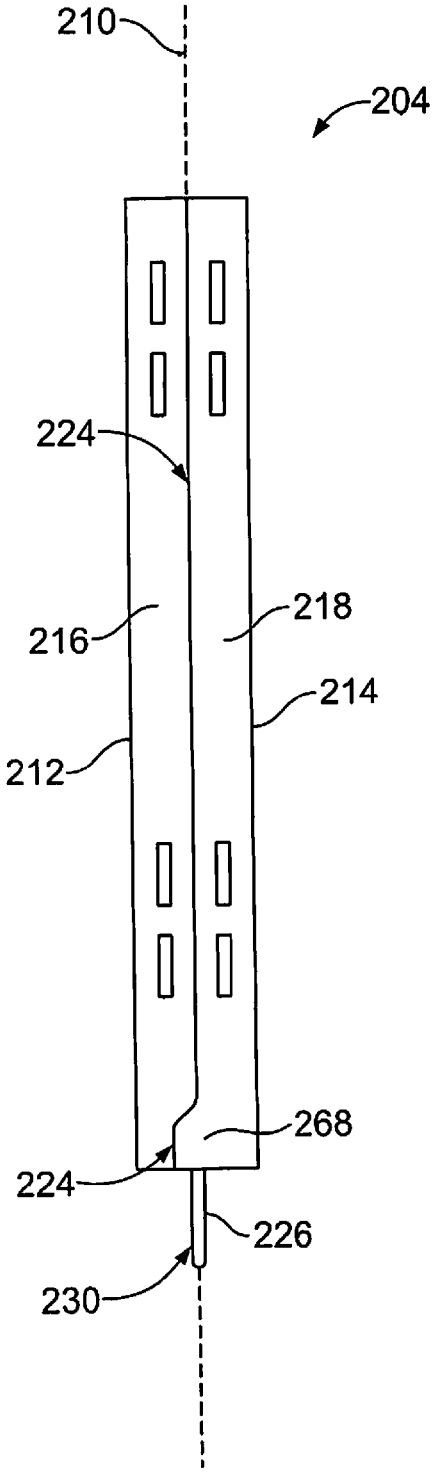
FIG. 4 is a front assembled view of the contact module of FIG. 3.

FIG. 3 is a front exploded view of a contact module 204 of the electrical connector 102 (shown in FIG. 1) according to an embodiment. FIG. 4 is a front assembled view of the contact module 204 of FIG. 3. The left signal wafer 216 and the right signal wafer 218 each have an inner side 260 and an outer side 262. The inner sides 260 of the left and right signal wafers 216, 218 face each other. The inner sides 260 may abut each other in the assembled contact module 204 to define the interface 224. The outer side 262 of the left signal wafer 216 defines the left outer side 212 of the contact module 204, and the outer side 262 of the right signal wafer 218 defines the right outer side 214 of the contact module 204. FIG. 3 shows the mating contacts 124 and mounting contacts 226 of the left and right signal wafers 216, 218. Only one of the four mounting contacts 226 in each signal wafer 216, 218 is visible because the mounting contacts 226 are aligned in a column 230 (shown in FIG. 2) and the other three contacts 226 are behind the visible contact 226. The portion of the electrical terminals 220 within the dielectric bodies 222 between the mating contacts 124 and the mounting contacts 226 is shown in phantom in FIG. 3.

In an embodiment, the electrical terminals 220 of at least one of the signal wafers 216, 218 in the contact module 204 are jogged in a jogged segment 268 proximate to the mounting edge 228 of the respective dielectric body 222. The electrical terminals 220 of at least one signal wafer are jogged towards the other signal wafer in the contact module 204. The terminals 220 are "jogged" such that the terminals 220 are bent or curved out of plane from another segment of the terminals 220. For example, the mating contacts 124 of the electrical terminals 220 extend in a first signal plane 264. The mounting contacts 226 of the electrical terminals 220 are offset from the first signal plane 264 by the jogged segment 268 such that the mounting contacts 226 extend in a second signal plane 266 that is different from the first signal plane 264. The electrical terminals 220 in the jogged segment 268 may have an S-curve such that the first and second signal planes 264, 266 are parallel to each other but spaced apart by a distance 270. In an exemplary embodiment, the electrical terminals 220 of both the left and the right signal wafers 216, 218 are jogged towards each other, as shown in FIG. 3.

As shown in FIG. 4, the left and right signal wafers 216, 218 are pressed against each other to form the assembled contact module 204. As the signal wafers 216, 218 are joined, the mounting contacts 226 of both the signal wafers 216, 218 align in a single column 230. The jogged segment 268 of the right signal wafer 218 is received in a recessed area 269 of the left signal wafer 216, as shown in FIG. 3. Likewise, the jogged segment 268 of the left signal wafer 216 may be received in a corresponding recessed area (not shown) of the right signal wafer 218. In an exemplary embodiment, the column 230 is a single file column having a width of only a single contact such that only one mounting contact 226 is visible from the front as shown in FIG. 4. The column 230 of mounting contacts 226 is parallel with the contact module plane 210. The column 230 in FIG. 4 is co-planar with the contact module plane 210. The contact module plane 210 may extend along and be co-planar with the interface 224 between the left and right signal wafers 216, 218, at least until the jogged segment 268 where the interface 224 is no longer co-planar with the contact module plane 210. As such, the column 230 may be co-planar with the portion of the interface 224 excluding the jogged segment 268.

Figure 5:
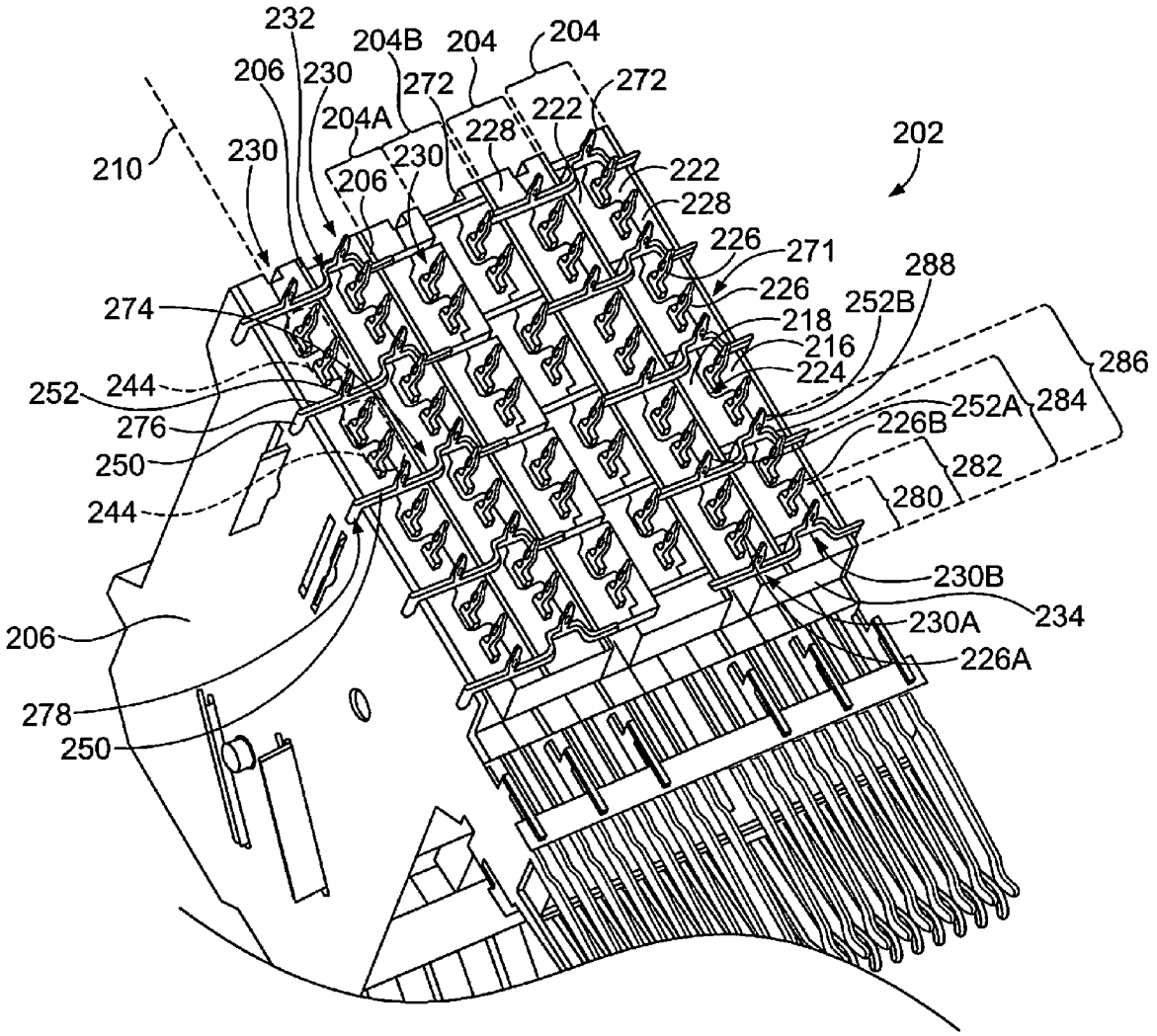
FIG. 5 is a bottom perspective view of a portion of the module stack of FIG. 2 according to an exemplary embodiment.

FIG. 5 is a bottom perspective view of a portion of the module stack 202 of FIG. 2 according to an exemplary embodiment. A bottom side 271 of the module stack 202 includes the mounting edges 228 of the dielectric bodies 222 of the contact modules 204. The mounting contacts 226 protrude from the mounting edges 228. The bottom side 271 of the module stack 202 is positioned at the mounting face 111 (shown in FIG. 1) of the housing 108 (FIG. 1).

The mounting contacts 226 of the contact modules 204 are aligned in the columns 230. Each column 230 is defined by the mounting contacts 226 of one of the contact modules 204. The columns 230 are parallel to each other. The columns 230 may each be co-planar with the contact module plane 210 of the respective contact module 204. In an exemplary embodiment, both the electrical terminals 220 (shown in FIG. 3) of the left and right signal wafers 216, 218 in each contact module 204 are jogged towards each other. As shown in FIG. 5, the mounting edges 228 of the left and right signal wafers 216, 218, due to the jogged segments 268 (shown in FIG. 3) of the electrical terminals 220 and the recessed areas 269 (FIG. 3) of the signal wafers 216, 218 that receive the jogged segments 268, define an undulating or snaking interface 224 between the mating edge 234 of the contact modules 204 and an opposite, rear edge 272 of the contact modules 204. The mounting contacts 226 of the left and right signal wafers 216, 218 are aligned in the contact module plane 210 and are disposed in an alternating sequence at respective different distances from the mating edge 234. When the signal wafers 216, 218 are aligned to form a contact module 204, the jogged segments 268 of the left signal wafer 216 intermesh with the jogged segments 268 of the right signal wafer 218. As such, the mounting contacts 226 of the left signal wafer 216 alternate with the mounting contacts 226 of the right signal wafer 218 along the length of the contact module 204 between the mating edge 234 and the rear edge 272.

The mounting contacts 226 may be arranged in pairs 244. The pairs 244 may be differential pairs configured to convey differential signals. Each column 230 includes multiple pairs 244 along the length of the column 230. In an exemplary embodiment, a respective ground cross connect 250 extends between corresponding adjacent pairs 244 of mounting contacts 226 in each column 230. The contact modules 204 may define slots 274 in the dielectric bodies 222 at the mounting edge 228 to receive the ground cross connects 250. A ground contact 252 of each ground cross connect 250 aligns with the mounting contacts 226 in a corresponding column 230. The mounting contacts 226 and ground contacts 252 in each column 230 may be aligned in a single file line between the mating edge 234 and the rear edge 272. In an embodiment, a ground contact 252 is disposed between two mounting contacts 226 in the same column 230 to provide shielding therebetween. For example, the two mounting contacts 226 on either side of the ground contact 252 may be parts of different differential pairs 244 of mounting contacts 226. The ground contact 252 thus provides shielding between adjacent differential pairs 244 within the same column 230.

The ground cross connects 250 include a body 276 from which the at least one ground contact 252 extends. In an embodiment, the body 276 of the ground cross connect 250 is received in a corresponding slot 274. The ground plates 206 may also include slots 278 that receive the bodies 276 of the ground cross connects 250. The ground cross connects 250 may be slid into the slots 274, 278 from the bottom 271 of the module stack 202. The bodies 276 of the ground cross connects 250 extend across at least one contact module 204 and the ground plates 206 on either side of the contact module 204. The slots 278 in the ground plates 206 may be sized and/or the bodies 276 of the ground cross connects 250 may be shaped such that the bodies 276 mechanically engage the corresponding ground plates 206 that the respective ground cross connects 250 extend across. The ground cross connects 250 are formed of a conductive material, such as metal, to electrically engage the ground plates 206 that the ground cross connects 250 mechanically engage, thereby forming a ground path between ground plates 206 to electrically common adjacent ground plates 206 in the module stack 202. The combination of the ground plates 206 at sides of the contact modules 204 and the ground cross connects 250 extending across the contact modules 204 may define conductive boxes around the pairs 244 of mounting contacts 226 at or near the mounting edge 228. The conductive boxes provide electrical shielding along all sides of the corresponding pairs 244.

In the illustrated embodiment, each of the ground cross connects 250 extend across two contact modules 204 and three ground plates 206 disposed on the sides of the contact modules 204. The three ground plates 206 may be electrically commoned to each other at multiple locations along the length of the ground plates 206 by the ground cross connects 250. The ground cross connects 250 each extend across a corresponding column void 232 defined by the columns 230 of mounting contacts 226 and ground contacts 252. In addition, the ground cross connects 250 in the illustrated embodiment each include two ground contacts 252. The two ground contacts 252 are disposed within respective different columns 230 of mounting contacts 226. In other embodiments, at least some of the ground cross connects 250 may extend across more than two contact modules 204 and/or may include more than two ground contacts 252. Optionally, ground cross connects 250 may not extend across at least some of the contact modules 204 of the module stack 202. For example, ground cross connects 250 do not extend across contact modules 204A and 204B in FIG. 5, and the contact modules 204A, 204B are not separated by a ground plate 206. Optionally, the mounting contacts 226 of the contact modules 204A, 204B may be low speed contacts, such as single ended contacts, that do not require the shielding provided by the ground plates 206 and ground cross connects 250. The mounting contacts 226 of the other contact modules 204 (other than the contact modules 204A, 204B) may be high speed contacts.

In an embodiment, the mounting contacts 226 and the ground contacts 252 in adjacent columns 230 are staggered such that the mounting contacts 226 and the ground contacts 252 of the adjacent columns 230 are offset at respective different distances from the mating edges 234 of the respective contact modules 204. The mating edges 234 of the contact modules 204 in the module stack 202 are used as reference points because the mating edges 234 are linearly aligned, such that each mating edge 234 is at the same relative position along the longitudinal axis 191 (shown in FIG. 1) of the electrical connector 102 (FIG. 1). For example, mounting contact 226A in column 230A is adjacent to mounting contact 226B in column 230B. Mounting contact 226A is separated from the mating edge 234 by a first distance 280. Mounting contact 226B is separated from the mating edge 234 by a second distance 282 that is greater than the first distance 280. Furthermore, the ground contacts 252 of adjacent columns 230 may also be offset. For example, ground contact 252A in column 230A is adjacent to ground contact 252B in column 230B. Ground contact 252A is separated from the mating edge 234 by a third distance 284. Ground contact 252B is separated from the mating edge 234 by a fourth distance 286 that is greater than the third distance 284. Because ground contacts 252A and 252B are coupled to the body 276 of the same ground cross connect 250, the body 276 includes an offset segment 288 that is jogged out of plane from the rest of the body 276. The ground contact 252B extends from the offset segment 288 of the body 276. The ground contact 252A, however, extends from the body 276 at a location spaced apart from the offset segment 288. The offset segment 288 is optionally jogged in a direction away from the mating edge 234, which causes the ground contact 252B to be disposed further from the mating edge 234 than the ground contact 252A.

Figure 6:
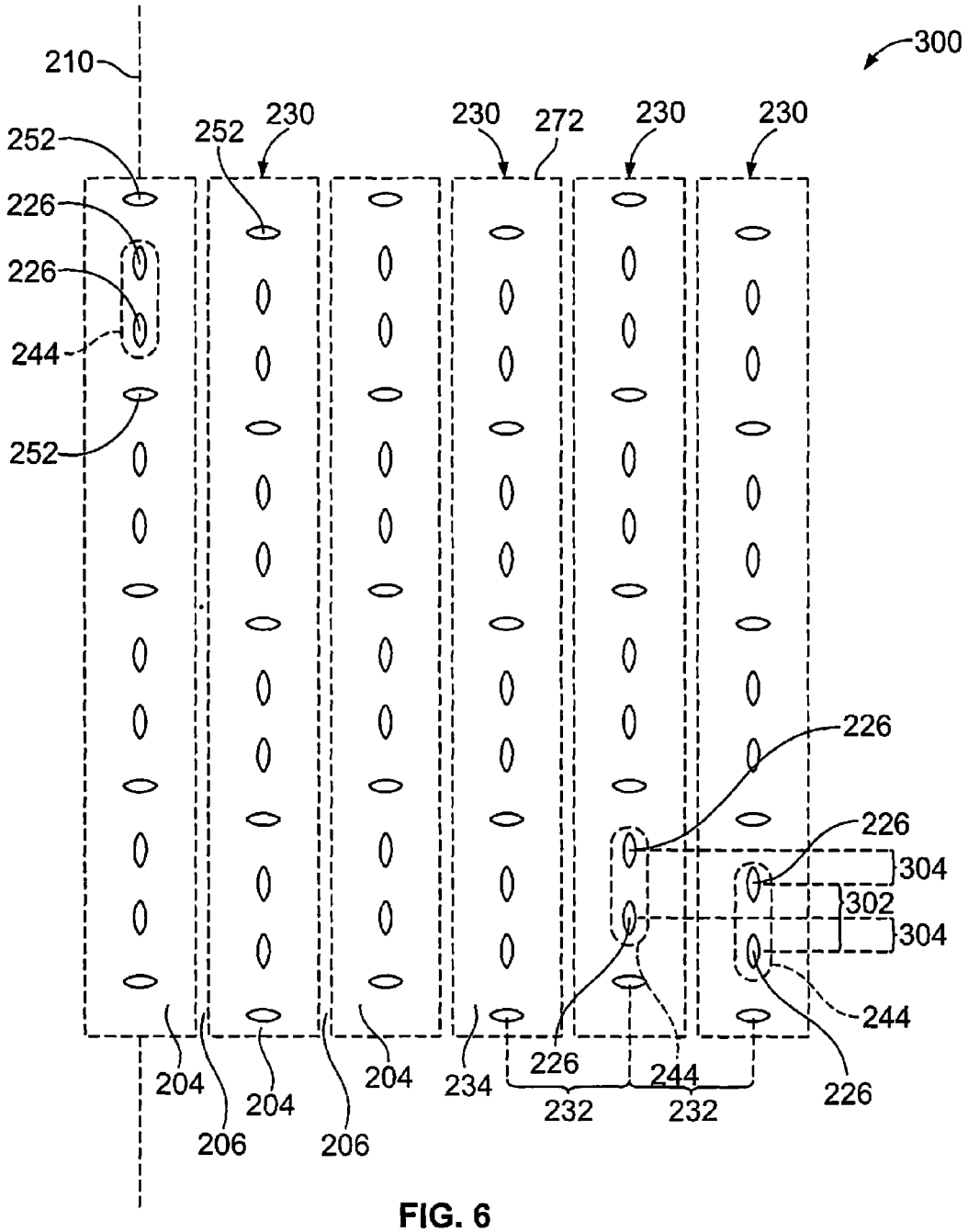
FIG. 6 illustrates a footprint of the electrical connector in accordance with an exemplary embodiment.

FIG. 6 illustrates a footprint 300 of the electrical connector 102 (shown in FIG. 1) in accordance with an exemplary embodiment. The footprint 300 is at the mounting face 111 (shown in FIG. 1) of the housing 108 (FIG. 1). The footprint 300 is defined by the layout of the mounting contacts 226 and the ground contacts 252. The mounting contacts 226 and the ground contacts 252 are arranged in an array at the mounting face 111. The array includes plural columns 230 that extend parallel to the contact module plane 210 of at least one contact module 204. The outlines of the contact modules 204 and ground plates 206 are shown in phantom. The ground contacts 252 extend from the ground cross connects 250 (shown in FIG. 5).

Adjacent columns 230 are separated by column voids 232. The column voids 232 extend parallel to the contact module plane 210. The column voids 232 extend from the mating edge 234 to the rear edge 272. The column voids 232 provide space within the footprint 300 of the electrical connector 102 (shown in FIG. 1) for routing electrically conductive traces 146 (shown in FIG. 1) along the circuit board 104 (FIG. 1) away from the footprint 300. For example, the column voids 232 allow for more conductive traces 146 to be routed under the footprint 300 on the same layer of the circuit board 104 than in other known electrical systems, which allows the circuit board 104 to have fewer layers, reducing cost and complexity. In addition, the column voids 232 may reduce cross-talk between mounting contacts 226 of adjacent contact modules 204.

The mounting contacts 226 are arranged as pairs 244. The pairs 244 of mounting contacts 226 may be differential pairs. The mounting contacts 226 of each pair 244 are disposed in the same column 230 and separated from each other by a pitch 302, wherein pitch is defined as a dimension between centerpoints of the contacts 226. In an embodiment, the mounting contacts 226 in adjacent columns 230 are staggered such that the mounting contacts 226 in one column 230 are disposed at a distance from the mating edge 234 that is a half-pitch 304 (for example, half of the pitch 302) further than the mounting contacts 226 in an adjacent column 230. In other embodiments, the mounting contacts 226 of adjacent columns 230 may be staggered by distances other than half of the pitch 302 between pairs 244 of mounting contacts 226.

Figure 7:
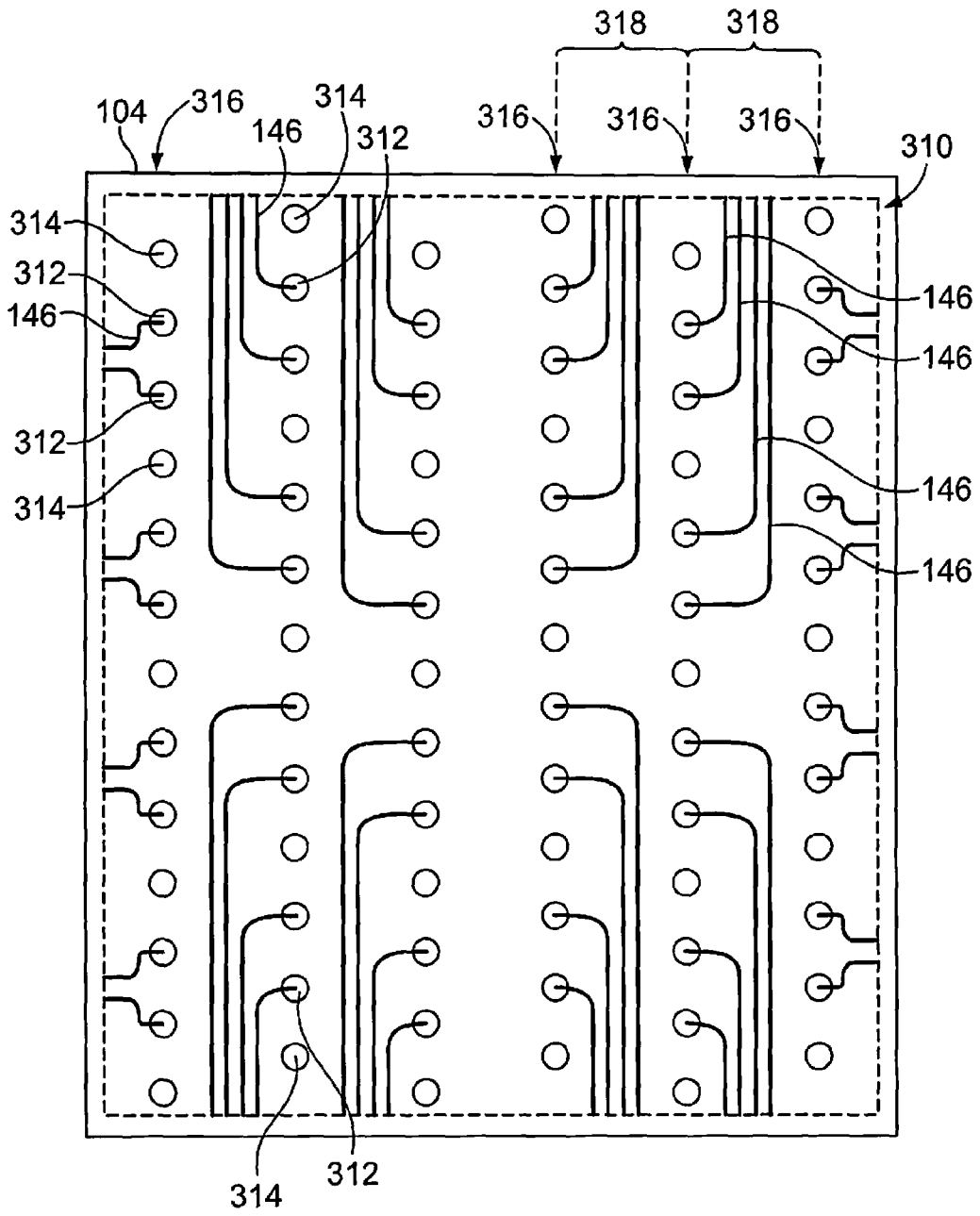
FIG. 7 illustrates a circuit board showing a footprint of signal vias and ground vias that corresponds to the layout of the contacts of the electrical connector.

FIG. 7 illustrates the circuit board 104 showing a footprint 310 of signal vias 312 and ground vias 314 that corresponds to the layout of the mounting contacts 226 (shown in FIG. 6) and the ground contacts 252 (FIG. 6) of the electrical connector 102 (shown in FIG. 1). For example, the signal vias 312 are configured to receive the mounting contacts 226, and the ground vias 314 are configured to receive the ground contacts 252. The mounting contacts 226 mechanically engage the corresponding signal vias 312 to electrically connect the electrical terminals 220 (shown in FIG. 2) to the vias 312. The signal vias 312 are each coupled to a conductive trace 146 that extends from the corresponding signal via 312 and is routed through the footprint 310 on the circuit board 104. FIG. 7 illustrates an embodiment where the conductive traces 146 from all of the signal vias 312 are routed out from under the electrical connector 102 on one layer. Other layers of the circuit board 104 may be used for routing traces from other components, which may allow for a reduction in the overall size of the circuit board 104.

The signal vias 312 and ground vias 314 are arranged in columns 316 that correspond to the columns 230 (shown in FIG. 6) of the mounting contacts 226 (FIG. 6) and ground contacts 252 (FIG. 6). In an exemplary embodiment, at least some of the conductive traces 146 extend along and within routes 318 defined between adjacent columns 316 of vias 312, 314. When the electrical connector 102 (shown in FIG. 1) is mounted to the circuit board 104, the routes 318 align with the column voids 232 (shown in FIG. 6). The routes 318 are wide enough to support multiple conductive traces 146 side-by-side. For example, although a maximum of four traces 146 are shown side-by-side in the routes 318 in FIG. 7, the routes 318 may provide enough space for more than four traces 146, such as six, eight, or ten traces 146).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mounting face and a mating face;

a plurality of contact modules held by the housing, each contact module including a left signal wafer and a right signal wafer stacked next to each other along a stack axis, the left and right signal wafers extending parallel to a contact module plane, the left and right signal wafers each including electrical terminals held by a dielectric body, the electrical terminals having mounting contacts protruding from the dielectric body at the mounting face of the housing, the electrical terminals of at least one of the signal wafers in each contact module being jogged toward the other signal wafer in the contact module such that the mounting contacts of the left signal wafer align with the mounting contacts of the right signal wafer in a column that extends parallel to the contact module plane; and a plurality of ground plates held by the housing, each of the ground plates extending parallel to the contact module plane and disposed along an outer side of a corresponding contact module.

2. The electrical connector of claim 1, wherein the left and right signal wafers each have an inner side and an outer side, the inner sides of the left and right signal wafers facing each other to define an interface, the column of mounting contacts being co-planar with the interface.

3. The electrical connector of claim 1, wherein the electrical terminals further include mating contacts protruding from the dielectric body at least proximate to the mating face of the housing, the mating contacts of the jogged electrical terminals extending in a first signal plane, the mounting contacts of the jogged electrical terminals extending in a second signal plane that is different from the first signal plane.

4. The electrical connector of claim 1, wherein the mounting contacts in adjacent columns are staggered such that the mounting contacts of the adjacent columns are offset at respective different distances from the mating face of the housing.

5. The electrical connector of claim 4, wherein the mounting contacts are arranged as differential pairs, the mounting contacts of each differential pair disposed in the same column and separated from each other by a pitch, wherein, the mounting contacts in adjacent columns are staggered such that the mounting contacts in one column are disposed at a distance from the mating face that is a half-pitch farther than the mounting contacts in the adjacent column.

6. The electrical connector of claim 1, further including ground cross connects at the mounting face of the housing, each ground cross connect extending across at least one contact module and electrically and mechanically engaging corresponding ground plates at opposite sides of the at least one contact module, the ground cross connects each having at least one ground contact that aligns with the mounting contacts in a corresponding column, at least some of the ground contacts being disposed between two mounting contacts in the corresponding column to provide shielding therebetween.

7. The electrical connector of claim 6, wherein each ground cross connect extends across at least two contact modules and includes at least two ground contacts aligned in different columns, wherein a first ground contact of the ground cross connect is staggered from a second ground contact of the ground cross connect such that the first and second ground contacts are offset at different distances from the mating face of the housing.

8. The electrical connector of claim 6, wherein the mounting contacts are arranged as differential pairs, each column including plural differential pairs, at least some of the ground contacts in each column being disposed between adjacent differential pairs within the column to provide shielding therebetween.

9. The electrical connector of claim 1, wherein the electrical terminals of both the left and right signal wafers in each contact module are jogged towards each other.

10. The electrical connector of claim 1, wherein the contact modules and the ground plates are arranged in an alternating sequence along the stack axis.

11. The electrical connector of claim 1, wherein the column of one contact module is separated from an adjacent column of an adjacent contact module by a column void, the mounting face of the housing is configured to be mounted on a circuit board that includes plural vias configured to receive the mounting contacts therein, the vias each having a corresponding conductive trace extending therefrom, at least some of the conductive traces extending along a route defined between columns of vias, the route aligning with the column void when the housing is mounted to the circuit board.

12. The electrical connector of claim 1, wherein all of the mounting contacts in a corresponding contact module align in one column.

13. An electrical connector comprising:

a housing having a mounting face and a mating face;

a plurality of contact modules held by the housing, each contact module including a left signal wafer and a right signal wafer stacked next to each other along a stack axis, the left and right signal wafers extending parallel to a contact module plane, the left and right signal wafers each including electrical terminals held by a dielectric body, the electrical terminals having mounting contacts protruding from the dielectric body at the mounting face of the housing;

a plurality of ground plates held by the housing, each of the ground plates extending parallel to the contact module plane and disposed along an outer side of a corresponding contact module; and a plurality of ground cross connects at the mounting face of the housing, each ground cross connect extending across at least one contact module and electrically and mechanically engaging corresponding ground plates at opposite sides of the at least one contact module, the ground cross connects each having at least one ground contact, wherein the mounting contacts and the ground contacts are arranged in plural columns extending parallel to the contact module plane, each column having at least one ground contact disposed between mounting contacts to provide shielding therebetween, adjacent columns being separated by a column void.

14. The electrical connector of claim 13, wherein the electrical terminals of at least one of the signal wafers in each contact module are jogged toward the other signal wafer in the contact module such that the mounting contacts of the respective left signal wafers align with the mounting contacts of the respective right signal wafer in one of the columns.

15. The electrical connector of claim 14, the electrical terminals further include mating contacts protruding from the dielectric body at least proximate to the mating face of the housing, the mating contacts of the jogged electrical terminals extending in a first signal plane, the mounting contacts of the jogged electrical terminals extending in a second signal plane that is different from the first signal plane.

16. The electrical connector of claim 13, wherein the mounting contacts and the ground contacts in adjacent columns are staggered such that the mounting contacts and the ground contacts of the adjacent columns are offset at different distances from the mating face of the housing.

17. The electrical connector of claim 16, wherein the mounting contacts are arranged in pairs, the mounting contacts of each pair disposed in a same column and separated from each other by a pitch, wherein, the mounting contacts in adjacent columns are staggered such that the mounting contacts in one column are disposed at a distance from the mating face that is a half-pitch farther than the mounting contacts in an adjacent column.

18. The electrical connector of claim 13, wherein the mounting contacts and the ground contacts in each column are aligned in a single file line.

19. The electrical connector of claim 13, wherein each ground cross connect extends across at least two of the contact modules and across the column void defined between the respective columns defined at least partially by the mounting contacts of the at least two contact modules, each ground cross connect including at least two ground contacts that align in different columns of the respective columns.

20. The electrical connector of claim 19, wherein a first ground contact of one ground cross connect is staggered from a second ground contact of the ground cross connect such that the first and second ground contacts are offset at different distances from the mating face of the housing.

* * * * *